United States Patent [19]

Beruvides

[11] Patent Number: 4,697,715

[45] Date of Patent: Oct. 6, 1987

[54] ANTICOCKING HIGH TORQUE REMOVAL CLOSURE ASSEMBLY

[75] Inventor: Mario Beruvides, Miami, Fla.

[73] Assignee: Waynesboro Textiles, Forest City, N.C.

[21] Appl. No.: 901,925

[22] Filed: Sep. 2, 1986

[51] Int. Cl.[4] ..... B65D 41/04

[52] U.S. Cl. ..... 215/330

[58] Field of Search ..... 215/330; 220/289

[56] References Cited

U.S. PATENT DOCUMENTS 4,125,201 11/1978 Birch ..... 215/330

4,349,116 9/1982 Luenser ..... 215/330

*Primary Examiner*—Donald F. Norton

*Attorney, Agent, or Firm*—Thomas R. Vigil

[57] ABSTRACT

The anticocking high torque removal closure assembly comprises a container having a neck, a cap threadingly received on the neck, a first thread on the neck, a second thread in the cap, and a rib in the cap spaced from a revolution of the second thread and having a sharp outer edge. The first thread has an upper surface, a side surface and a lower surface, the second thread has an upper surface, a side surface and a lower surface.

A first "allowable cock dimension" (ACD) is defined between a horizontal line through the junction of the side surface and the lower surface of the second thread and a horizontal line through the junction of the neck with the upper surface of the first thread when the cap is received on the neck. A second "minimum cock dimension" (MCD) is defined between a horizontal line through the sharp outer edge of the rib and a horizontal line through the junction between the side surface and the lower surface of the first thread when the cap is received on the neck.

The "minimum cock dimension " MCD is designed to be greater than the "allowable cock dimension" for extremes of tolerances of the cap and the neck, such as neck high/cap low or neck low/cap high, to prevent cocking of the first thread above the rib when the cap is received on the neck.

14 Claims, 11 Drawing Figures

FIG. 9
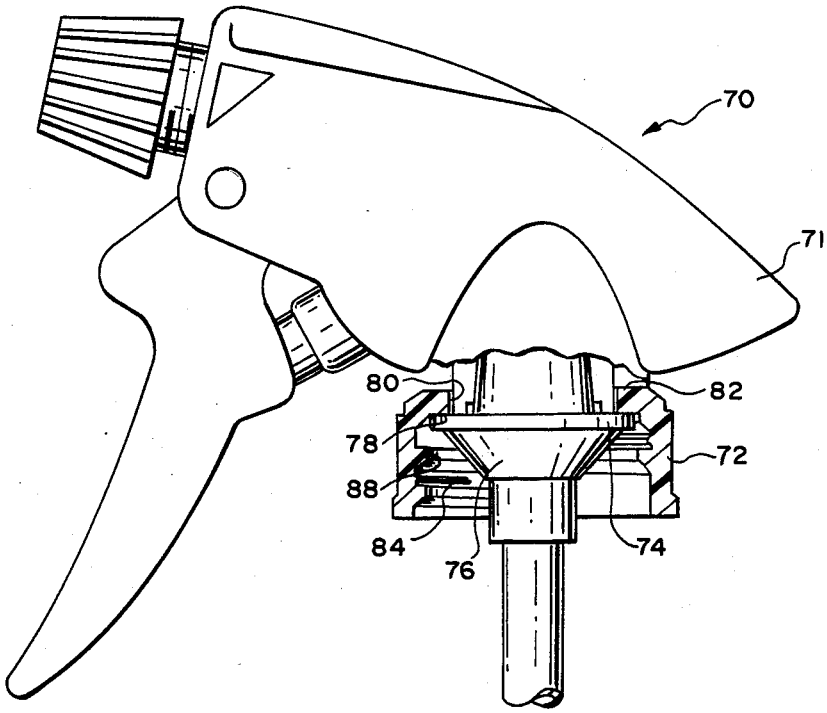
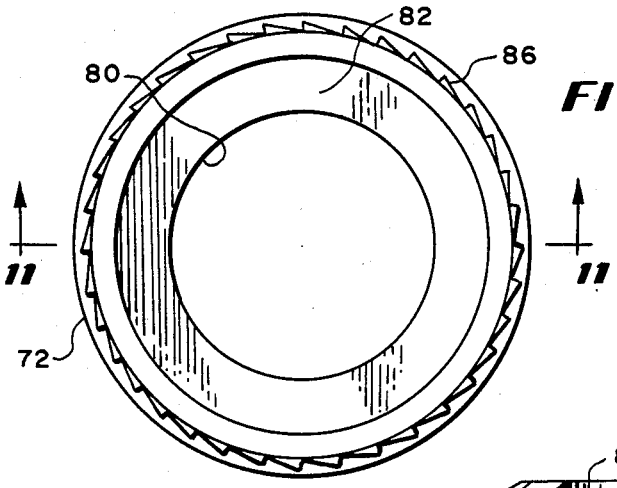
FIG. 10
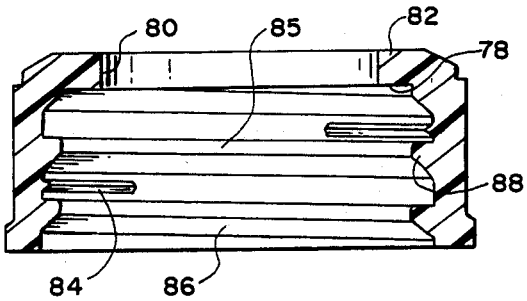
FIG. 11

ANTICOCKING HIGH TORQUE REMOVAL CLOSURE ASSEMBLY

BACKGROUND OF THE INVENTION

1. Field of the Invention

The present invention relates to a threaded closure assembly of a cap and neck of a bottle or container, which assembly provides high torque removal, and in particular, to an assembly of a cap on a neck where the cap has at least one locking rib and a thread on the neck which engages the rib. The assembly is desired to prevent cocking of the neck thread above the rib for a wide range of dimensions of the rib and of the threads on the neck and in the cap.

2. Description of the Prior Art

A problem with threaded closure caps is the tendency of the cap to loosen during shipping and handling as the material of which the cap is made starts to creep or relax. This tendency is not just a problem of the cap coming off the container neck on which it is initially received but also, this loosening prevents proper sealing of the cap which can lead to spoilage and/or spillage of the product inside the container.

In many of the previously proposed threaded closure cap assemblies, friction, which is generated between the normal mating of threads is relied upon to prevent the loosening tendency described above. However, this friction is usually insufficient to prevent loosening, especially when different thread tolerances between the container neck thread and the cap thread are encountered. Such a situation poses a problem when one thread, e.g., the container neck thread, is at a low tolerance and the other thread, the cap thread, is at a high tolerance and vice versa. When such adverse range of dimensional tolerances is encountered, there will not be sufficient friction created between the threads to prevent their loosening since space will exist between the threads.

Additionally, prior attempts to provide increased friction between the container neck thread and the cap thread by increasing the depth of one of the cap threads has not been fully effective. By this technique, increased friction is established by having the increased depth thread on the cap contact the neck of the container between revolutions of the container neck thread. This extra contact provides increased surface area contact to increase friction between the cap and the container neck and also forces the increased depth thread of the cap into the neck of the container.

However this technique has not proved to be effective for several different reasons. One problem is that the increased depth thread can cause deformation of the container neck which may be critical. Also, although increased friction is achieved by the contact of the increased depth thread with the container neck, friction which would normally exist between the other thread is diminished since the increased depth thread will tend to push the cap away from the container neck when the cap is tightened. This is especially true if the material of the container neck is relatively hard and does not deform properly.

Another problem with this method is that increased friction is not properly achieved when different tolerances of the cap and container neck threads are encountered. For instance, if the container neck thread tolerance is low and the cap thread tolerance is high, it is possible that the increased depth thread will not contact the container neck. Instead, it will jam into the container threads which will provide some additional friction but will also cause thread deformation which may prevent removal of the cap or prevent resealing of the cap on the container.

Another prior method for providing increased friction is the addition of an high torque removal thread with a smaller depth located slightly above the top thread of the cap. This additional high torque removal thread attempts to provide increased friction by jamming the container neck thread upward against the top of the top cap thread.

This method can be effective when nominal thread tolerances are encountered but loses its effectiveness in its application when different extremes of tolerances are encountered in both the cap and container threads. Specifically, mismatching of thread tolerances produces a situation known as thread cocking where the container neck thread cocks above the high torque removal thread.

As will be described in greater detail hereinafter, proper mating of the threads in any increased friction or high torque removal cap is essential. When using the method of providing an additional high torque removal thread or rib with a smaller depth, if the cap thread tolerance is high and the container thread tolerance is low, no jamming of the container thread is achieved since there will be too much space between the smaller depth rib and the top of the upper thread of the cap. Alternatively, if the cap thread tolerance is low and the container neck thread tolerance is high, the container thread will not seat properly within the cap thread to allow the smaller thread to jam the container neck thread in the proper manner.

Examples of previously proposed closure assemblies having high torque removal or anti-backoff characteristics are disclosed in the following U.S. Pat Nos:

| U.S. Pat. No. | PATENTEE |
|---|---|
| 3,295,708 | Watten Jr. |
| 3,696,957 | Van Boarn |
| 4,084,716 | Bogert |
| 4,084,717 | King |
| 4,193,509 | Dunn, Jr. et al. |
| 4,294,370 | Tueppen |
| 4,345,691 | Burke |
| 4,349,116 | Luenser |

The Luenser U.S. Pat. No. 4,349,116 discloses a closure cap having a secondary helical thread which will flex in response to a tightening torque.

As will be described in greater detail hereinafter, the anticocking high torque removal closure assembly of the present invention differs from the assemblies previously proposed by providing a rib (high torque removal thread) of smaller thread depth located above or below the top thread in a cap of the assembly. This rib provides increased friction by engaging a container neck thread at a point, which causes slight deformation of the front face of the container neck thread while providing the increased friction necessary to prevent backing off of the cap during shipping and handling.

Additionally, the closure assembly of the present invention is not defeated by different thread tolerances since the width of the top thread in the cap of the assembly is chosen so that proper engagement of the rib with the front face of a container neck thread takes place without cocking of the neck thread above the rib.

SUMMARY OF THE INVENTION

According to the present invention there is provided an anticocking high torque removal closure assembly comprising:

a container having a neck;

a cap threadingly received on said neck;

a first thread on said neck;

a second thread in said cap;

a rib in said cap spaced from a revolution of said second thread and having a sharp outer edge said first thread having an upper surface, a side surface and a lower surface;

said second thread having an upper surface, a side surface and a lower surface;

a first allowable cock dimension (ACD) being defined between a horizontal line through the junction of said side surface and said lower surface of said second thread and a horizontal line through the junction of said neck with said upper surface of said first thread when said cap is received on said neck;

a second minimum cock dimension (MCD) being defined between a horizontal line through said sharp outer edge of said rib and a horizontal line through the junction between said side surface and said lower surface of said first thread when said cap is received on said neck; and said minimum clock dimension MCD being greater than said allowable cock dimension for extremes of tolerances of said cap and said neck, such as neck high-/cap low or neck low/cap high, to prevent cocking of said first thread above said rib.

BRIEF DESCRIPTION OF THE DRAWINGS

FIG. 9 is a side elevational view of a trigger sprayer assembly with portions broken away including a cap constructed according to the teachings of the present invention.

FIG. 10 is a top plan view of the cap of the trigger sprayer assembly shown in.

FIG. 11 is a vertical sectional view of the cap shown in FIG. 9, is taken along line 11—11 of FIG. 10 and shows a high torque removal rib in the cap situated between revolutions of the thread in the cap.

DESCRIPTION OF THE PREFERRED EMBODIMENT

Figure 1:
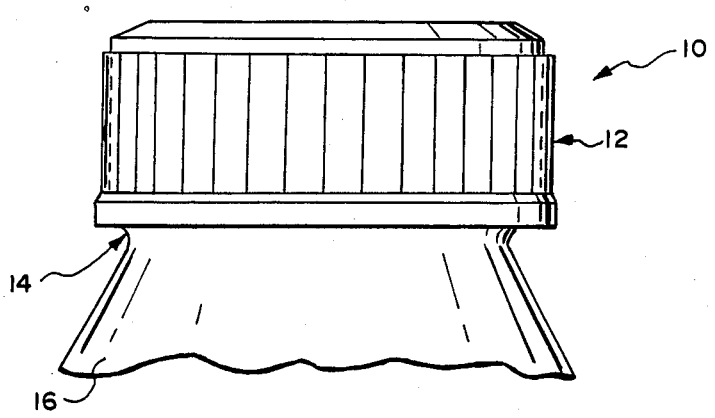
FIG. 1 is a side view of the closure assembly of the present invention including a cap threadedly attached to a neck of a container.
Figure 2:
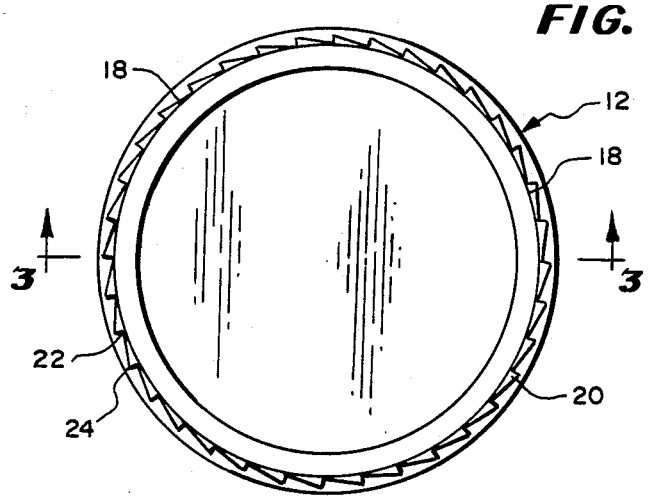
FIG. 2 is a top plan view of the threaded closure assembly shown in FIG. 1.

Referring now to the drawings in greater detail, there is illustrated in FIG. 1 an anti-cocking, high torque removal closure assembly 10 constructed in accordance with the teachings of the present invention.

The assembly 10 includes a cap 12 mounted on a neck 14 of a container 16. As shown in FIGS. 1–4, the outer cylindrical surface 18 of the cap 12 is preferably provided with a plurality of gripping ribs 20 each of which extends axially or vertically of the cap 12 and has a radially inner end 22 and a radially outer end 24, the radial inner end of one rib 20 being radially inwardly of the radially outer end of an adjacent rib 20 such that the ribs 20 have a generally sawtooth formation to enhance gripping of an application of a torque to the cap 12.

In accordance with the teachings of the present invention, the cap 12 has, on inner cylindrical surface 26 thereof, a cap thread 28 which extends helically downwardly from an upper end 30 to a lower end 32. Positioned above the upper or top revolution of the cap thread 28 is a high torque removal or anti-backoff rib 34.

Figure 4:
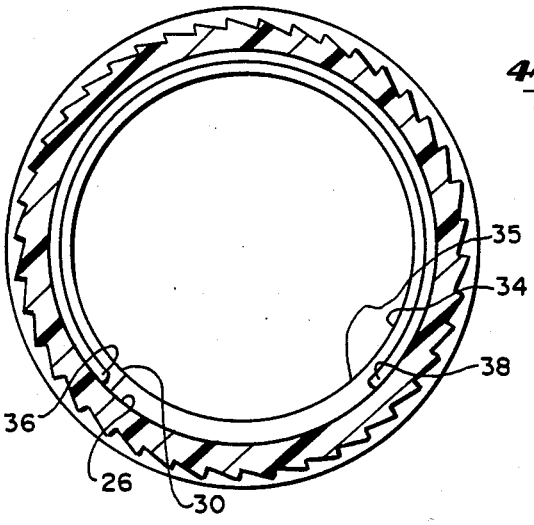
FIG. 4 is an horizontal sectional view of the cap, is taken along line 4—4 of FIG. 3, and shows the circular extent of a rib in the cap.
Figure 3:
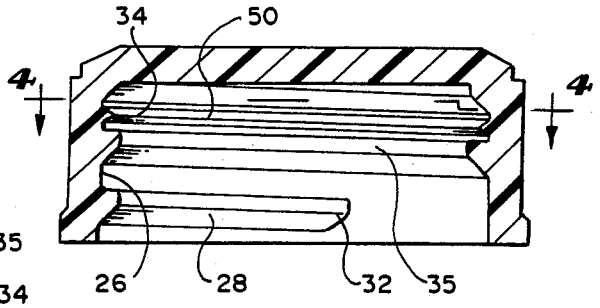
FIG. 3 is a vertical sectional view of the threaded cap of the closure assembly and is taken along line 3—3 of FIG. 2.
Figure 5:
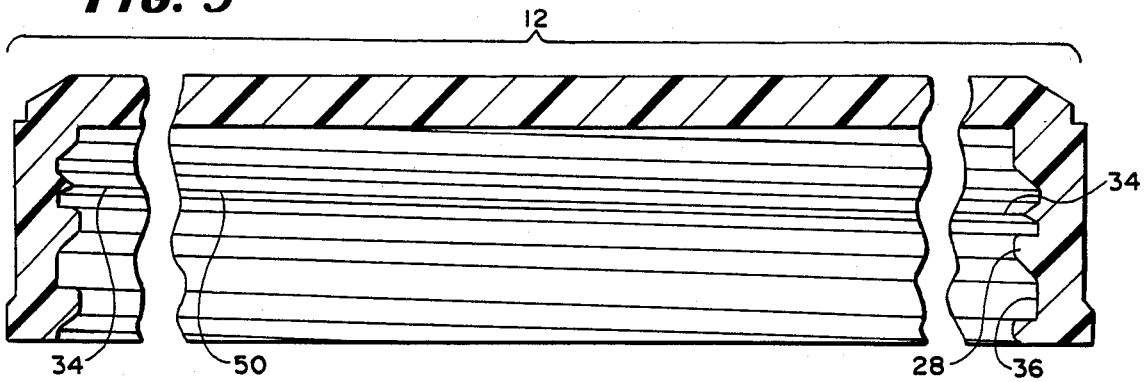
FIG. 5 is a vertical unwarapped interior view of the cap shown in FIG. 4 after the top of the cap is cut away, a cut is made through the side wall of the cap and the top side wall is unwrapped or unraveled.

As will be described in greater detail hereinafter, this rib 34 can extend above a top or upper revolution 35 of the cap thread 28 or can extend between two revolutions of the thread 28 (as shown in the embodiment illustrated in FIG. 11). Furthermore, as shown in FIG. 4, the rib 34 extends at least 180° helically downwardly (or upwardly) from its upper and 36 between approximately 180° and 360° around the inner surface 26 of the cap 12 and preferably, as shown in FIG. 4, 270° to a lower end 38. The rib 34 can begin at a point vertically above the beginning of the thread 28 or at some point up to 360° helically downwardly or upwardly from the upper end 30 or lower end 32 of the cap thread 28. One beginning location is approximately 195° helically downwardly or upwardly from the lower end 32 of the cap thread 28 and another beginning location is 360° helically upwardly from the lower end 32 of the cap thread 28. The cap thread 28 can have two or more revolutions depending upon the axial extent or height of the cap 12.

Figure 6:
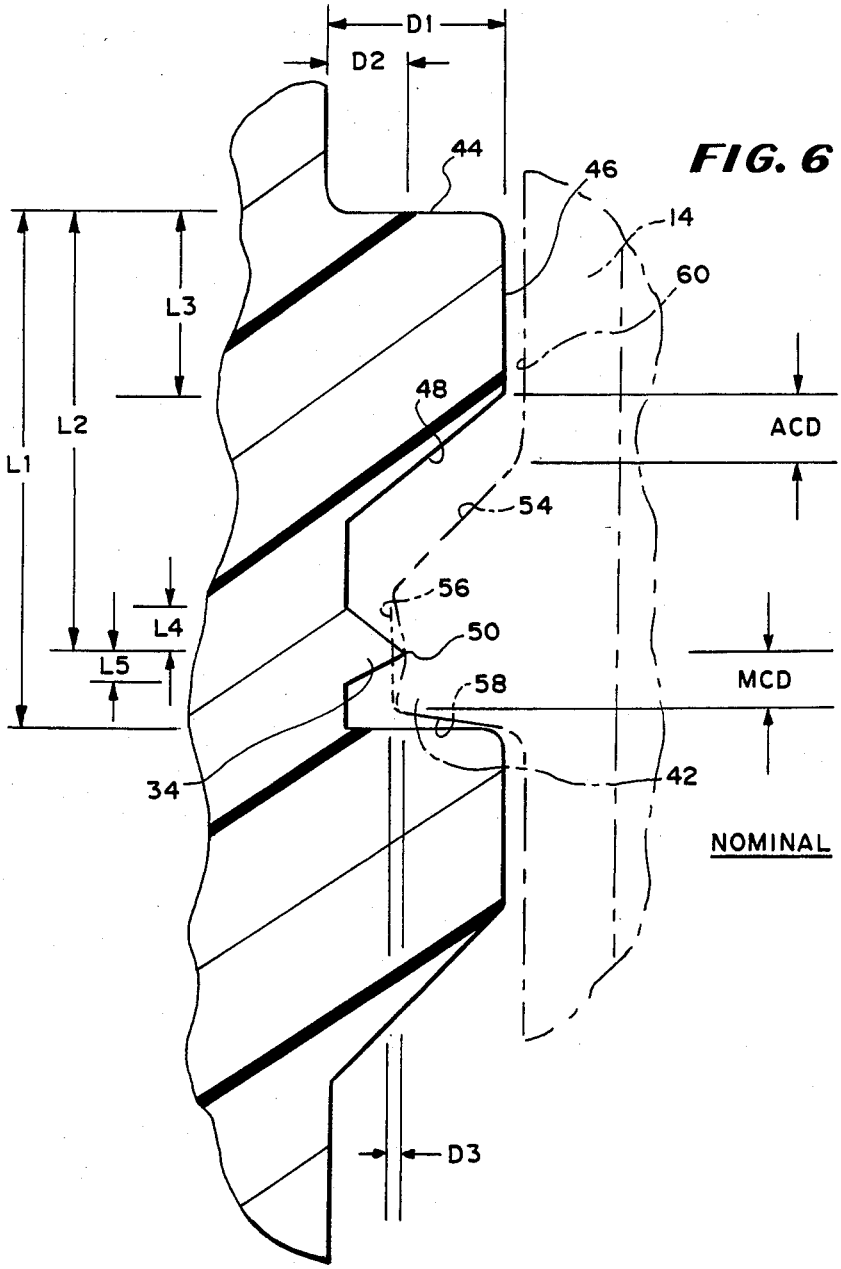
FIG. 6 is an enlarged fragmentary, vertical sectional view of the thread and rib in the cap shown in FIG. 5 and, in dashed lines, of the thread on the neck and shows the nominal dimension of the cap and the neck for one embodiment of the closure assembly.

As best shown in FIG. 6, the neck 14 of the container 16 also has a neck thread 42 which is shown in phantom in FIG. 6 and which has approximately the same pitch as the cap thread 28 and which extends helically around the neck 42 so as to threadingly mate or engage with the cap thread 28 in the cap 12 when the cap 12 is threaded received over the neck 14.

As shown in FIG. 6, the cap thread 28 has an upper surface 44, a side surface 46, and a lower surface 48 as it extends around the inside of the cap 12.

The rib 34 is generally triangular in cross section and has a sharp outer edge 50 as shown.

The neck thread 42 also has an upper surface 54, a side surface 56, and a lower surface 58 as it extends around an outer surface 60 of the neck 14. As shown in FIG. 6, the rib 34 can be located between revolutions of the cap thread 28 so as to be in position to bear against or cut into the side surface 56 of the neck thread 42.

In FIG. 6, the nominal dimensions L1, L2, L3, L4, L5, D1, D2, D3, ACD and MCD of and between the cap thread 28 and portions of the cap 12 and the neck thread 42 are shown. The nominal values and tolerances of the L and D dimensions are as follows:

L1=0.166 inch
L2=0.143 inch±0.003
L3=0.057 inch±0.007
L4=0.032 inch±0.002
L5=0.012 inch±0.001
D1=0.058 inch±0.001
D2=0.025 inch±0.001
D3=0.008 inch+0.006,−0.007.

In particular, it is to be noted that a first dimension is defined between a horizontal line through the junction of the side surface 46 and the lower surface 48 of the cap thread 28 and a horizontal line through the junction between the neck outer surface 60 and the upper surface 52 of the neck thread 42 when the cap 12 is received on the neck 14, is identified as an "allowable cock dimension" or simply, ACD. The nominal value and tolerance of ACD is 0.014 inch+0.010,−0.005.

Then, another dimension is defined between a horizontal line extending through the sharp outer edge 50 of the rib 34 and the junction between the side surface 56 and lower surface 58 of the neck thread 42. This dimension is identified as the "minimum cock dimension" or simply, MCD. The nominal value and tolerance of MCD is 0.018 inch+0.002,−0.003.

Figure 7:
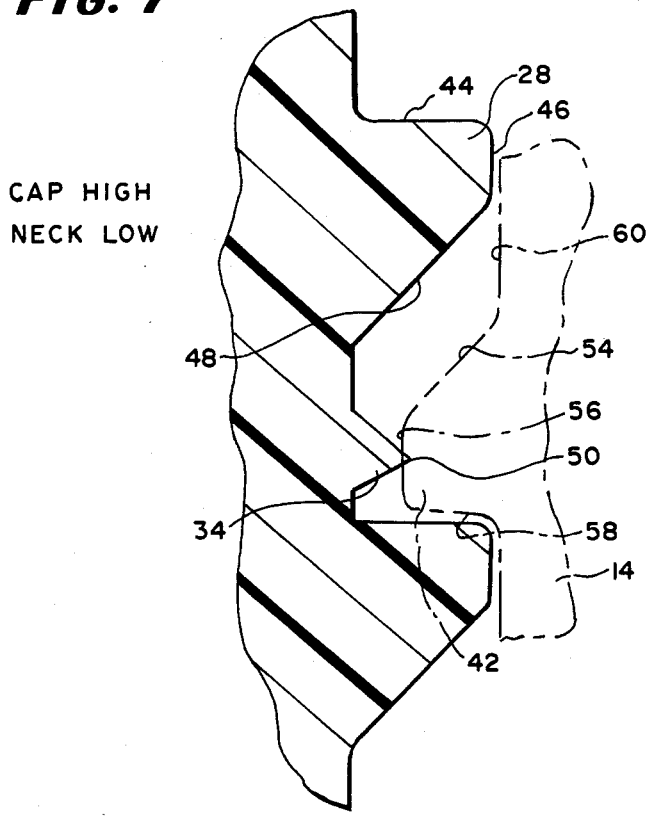
FIG. 7 is a fragmentary vertical sectional view, similar to the view shown in FIG. 6, but shows the cap with tolerance dimensions high and the neck with tolerance dimensions low.

In accordance with the teachings of the present invention, MCD is designed to be greater than ACD for all extremes of tolerance dimensions of the cap 12 and neck 14. In this respect, and as shown in FIG. 7, when the cap 12 tolerance dimensions are at their highest value and the neck 14 tolerance dimensions are at their lowest value, the high torque removal rib 34 will still engage and deform or gouge into the side surface 56 of the neck thread 42. In this case ACD, for the dimensions given in FIG. 6 for one embodiment of the cap 12 and neck 14, will be 0.012 inch and MCD will be 0.020 inch. Here it is to be understood that by "cap high tolerance dimension" and "neck low tolerance dimension" is meant the condition where the internal diameter of the cap is highest and the outer diameter of the neck is lowest as apparent in FIG. 7 where the sharp edge 50 of the rib 34 minimally engages in the side surface 56 of the neck thread 42.

Figure 8:
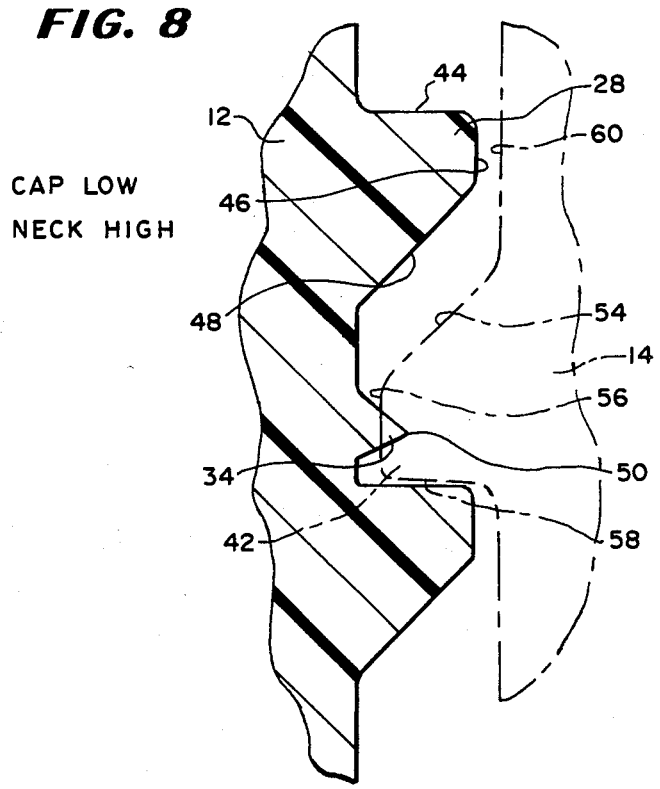
FIG. 8 is a fragmentary vertical section view, similar to the view shown in FIG. 6, but shows the cap with tolerance dimensions low and the neck with tolerance dimensions high.

In FIG. 8 there is shown the other worst case condition where the cap 12 tolerance dimensions are at their lowest value and the neck 14 tolerance dimensions are at their highest value. Here, for the dimensions given in FIG. 6, ACD will be 0.012 inch and MCD will be 0.015 inch.

In both cases, MCD is greater than ACD.

It has been found desirable that ACD for the various tolerance dimensions of the cap 12 and neck 14 be approximately 75% of MCD.

With the closure assembly 10 of the present invention constructed so that with the extremes of tolerance dimensions between the cap 12 and the neck 14, the mimimum cock dimension MCD is always greater than the allowable cock dimension ACD, the situation where the neck thread 42 cocks above the rib 34 in the space between the rib 34 and an upper revolution of the cap thread 28 is avoided.

This problem of cocking is often incurred where there is a mismatch of tolerances, i.e, the tolerance dimensions are at their extremes or worst case, and the force of the rib 34 against the side surface 56 of the cap 12 during the application of a torque to the cap 12 cause the neck thread 42 to cock above the rib 34.

Through empirical tests it was determined that this cocking and, of course, loss of the high torque removal function or anti-backing off function was overcome by constructing the closure assembly 10 so that with extremes of tolerances for the cap 12 and the neck 14 the minimum cock dimension, MCD, always exceeded the allowable cock dimension, ACD, as explained above.

Moreover, although in some embodiments it is desirable to have the high torque removal rib 34 located above the upper revolution 35 of the cap thread 28, so that the rib 34 is not encountered until the cap 12 is almost completely threaded onto the neck 14, it has also been found by empirical tests that it is desirable to have the rib begin approximately 360° helically upwardly from the lower end 32 of the lower revolution of the cap thread 28. This will ensure that one complete revolution of the neck thread 42 is engaged before high torque engagement of the rib 34 with the neck thread 42 is encountered.

Also, it is desirable that the rib 34 extend more than 180° around the inside surface 26 of the cap 12 to ensure that it will engage the side surface 56 of the neck thread 42. Obviously, if it is less than 180°, the cap 12 may be cocked to one side of the neck 14 without the rib 34 deforming or gouging into the side surface 56 of the neck thread 42.

The anti-cocking high torque removal closure assembly 10 of the present invention is particularly adapted for use in a trigger sprayer assembly 70, as shown in FIG. 9, which includes a trigger sprayer 71, a cap 72 which is adapted to be received over a neck (not shown) of a container.

The particular trigger sprayer 71 shown in FIG. 9 is of the type disclosed in U.S. Pat. No. 3,685,739.

Here the cap 72 is loosely held to the trigger sprayer 71 by a flange 74 on an intake body portion 76 of the trigger sprayer 71. As shown, this flange 74 bears against an annular undersurface 78 of the cap 72 adjacent to a central opening 80 in the top 82 of the cap 72 through which the intake body portion 76 extends. Here a rib 84 similar to the rib 34 extends between revolutions 85 and 86 of a thread 88 on the inside cylindrical surface 90 of the cap 72 as shown in FIGS. 9 and 11. Also, the cap 72 is substantially identical to the cap 12 shown in FIGS. 1–3 except for the opening 80 through the top 82 thereof. In this respect, the cap 72 has torque gripping ribs 86 (FIG. 11) on the outer surface thereof similar to the torque gripping ribs 20 of the cap 12 shown in FIG. 1.

From the foregoing description, it will be apparent that an anti-cocking high torque removal closure assembly 10 constructed according to the teachings of the present invention including a rib 34 with a sharp edge 50 formed on the inside of the cap 12 and adapted to engage a side surface 56 of a thread 42 on a neck 14 and with the cap 12 and the neck 14 having tolerance dimensions such that a defined "minimum cock dimension" is always greater than a defined "allowable cock dimension" engagement and deformation of the neck thread 42 by the rib 34 without cocking of the neck thread 42 on the rib 34 is obtained to ensure that a high torque removal or anti-backing off characteristic is achieved with the closure assembly 10 of the present invention.

Also it will be apparent from the foregoing description that the anti-cocking high torque removal closure assembly 10 of the present invention has a number of advantages, some of which have been described above and others of which are inherent in the invention. Accordingly, the scope of the invention is only to be limited as necessitated by the accompanying claims.

I claim

1. An anticocking high torque removal closure assembly comprising:

a container having a neck;

a cap threadingly received on said neck;

a first thread on said neck;

a second thread in said cap;

a rib in said cap spaced from a revolution of said second thread and having a sharp outer edge said first thread having an upper surface, a side surface and a lower surface;

said second thread having an upper surface, a side surface and a lower surface;

a first allowable cock dimension (ACD) being defined between a horizontal line through the junction of said side surface and said lower surface of said second thread and a horizontal line through the junction of said neck with said upper surface of said first thread when said cap is received on said neck;

a second minimum cock dimension (MCD) being defined between a horizontal line through said sharp outer edge of said rib and a horizontal line through the junction between said side surface and said lower surface of said first thread when said cap is received on said neck; and said minimum cock dimension MCD being greater than said allowable cock dimension for extremes of tolerances of said cap and said neck, such as neck high/cap low or neck low/cap high, to prevent cocking of said first thread above said rib.

2. The assembly of claim 1 wherein said rib is located above the top revolution of said second thread.

3. The assembly of claim 1 wherein said rib has a depth less than that of said second thread in said cap.

4. The assembly of claim 1 wherein said rib is located in said cap in a position to engage and deform said side surface of said first thread.

5. The assembly of claim 1 wherein said rib is located between two revolutions of said second thread.

6. The assembly of claim 1, wherein said rib begins approximately at a point vertically aligned with the upper end of said second thread and extends helically downwardly at least 180° around said cap.

7. The assembly of claim 1 wherein said rib extends between 180° and 360° around said cap.

8. The assembly of claim 7 wherein said rib extends 270° around said cap.

9. The assembly of claim 1 wherein said rib begins between approximately 180° and 360° helically upwardly from the lower end of the second thread.

10. The assembly of claim 9 wherein said rib begins approximately 195° helically upwardly from the lower end of the second thread.

11. The assembly of claim 9 wherein said rib begins approximately 360 helically upwardly from the lower end of the second thread.

12. The assembly of claim 9 wherein said rib extends between 180° and 360° around said cap.

13. The assembly of claim 12 wherein said rib extends 270° around said cap.

14. The assembly of claim 1 wherein said allowable cock dimension (ACD) is approximately 75% of the minimal cock dimension (MCD).

* * * * *